US010039334B2

(12) United States Patent
Thompson-Buist

(10) Patent No.: US 10,039,334 B2
(45) Date of Patent: Aug. 7, 2018

(54) REMOVABLE, INTERCHANGEABLE, MOISTURE RETAINING, FRICTION REDUCING HEAD-WEAR LINING

(71) Applicant: Yolanda Thompson-Buist, Hoogezand (NL)

(72) Inventor: Yolanda Thompson-Buist, Hoogezand (NL)

( * ) Notice: Subject to any disclaimer, the term of this patent is extended or adjusted under 35 U.S.C. 154(b) by 163 days.

(21) Appl. No.: 15/257,683

(22) Filed: Sep. 6, 2016

(65) Prior Publication Data

US 2018/0064196 A1 Mar. 8, 2018

(51) Int. Cl.

| | |
|---|---|
| ***A42C 5/00*** | (2006.01) |
| ***A42C 5/04*** | (2006.01) |
| ***A42B 1/20*** | (2006.01) |
| ***A42B 1/04*** | (2006.01) |

(52) U.S. Cl.
CPC ..... *A42B 1/205* (2013.01); *A42B 1/041* (2013.01)

(58) Field of Classification Search
CPC ..... A42B 1/205; A42B 1/041; A42B 1/069
See application file for complete search history.

(56) References Cited

U.S. PATENT DOCUMENTS

| | | | | |
|---|---|---|---|---|
| 1,050,310 A * | 1/1913 | Picker et al. | ..... | A42B 1/066 2/172 |
| 8,819,867 B1 * | 9/2014 | Boada | ..... | A42B 1/24 2/171 |
| 2005/0268382 A1 * | 12/2005 | Epling | ..... | A42B 1/069 2/411 |
| 2017/0042268 A1 * | 2/2017 | Lessard | ..... | A42B 1/041 |

* cited by examiner

*Primary Examiner* — Kristen Matter
(74) *Attorney, Agent, or Firm* — Chen-Chi Lin

(57) ABSTRACT

The present invention is a removable, reusable and interchangeable multi-shell lining configured for placement within a hat member, cap or any sort of head-wear for adjustable thermal comfort, moisture retention, reduction of friction thus reducing frizz and breakage of naturally dry and curly hair. The lining is comprised of a satin outer shell, satin-encased thermal middle shell and waterproof inner shell. The three shells, which are not bonded together, provide optimal moisture retention, reduction of friction of hair and thermal comfort. The three constituent shells are intended for contact with the wearer, can be interchanged and or used as a single shell lining while still maintaining hair moisture and reducing hair frizz and breakage.

3 Claims, 4 Drawing Sheets

REMOVABLE, INTERCHANGEABLE, MOISTURE RETAINING, FRICTION REDUCING HEAD-WEAR LINING

CROSS-REFERENCE TO RELATED APPLICATIONS

Not Applicable.

FEDERALLY SPONSORED RESEARCH OR DEVELOPMENT

Not Applicable.

INCORPORATION BY REFERENCE OF MATERIAL PRESENTED ON A COMPACT DISC

Not Applicable.

BACKGROUND OF THE INVENTION

Various types of removable head-wear linings are known however what is needed is a removable, reusable, interchangeable, multi-shell head-wear lining assembly for dry and curly hair that retains hair moisture, reduces friction against hair strands while allowing the wearer to easily control thermal comfort.

FIELD OF INVENTION

The present invention relates to a removable, reusable and interchangeable head-wear lining assembly and more particularly to shells that help retain moisture and reduce friction against dry and curly hair with adjustable insulation acting together as one optimal lining or separately as individual linings.

SUMMARY OF THE INVENTION

The purpose of the present invention, described subsequently in further detail, features a removable, reusable, interchangeable head-wear lining assembly. The inventive lining is configured for placement within a hat member, cap or any sort of head-wear for moisture retention, reduction of friction thus reducing frizz and breakage of naturally dry and curly hair and for adjustable thermal comfort. To achieve this the lining is comprised of three shell components which are made from choice performance materials. The three constituent shells, which are not bonded together, provide optimal moisture retention, frizz and breakage reduction of hair and thermal comfort for the wearer. All three shells are suitable for contact with the wearer and can be interchanged and or used as a single shell lining while still maintaining hair moisture and reducing hair frizz and breakage.

A first outer shell created for direct contact with the wearer is a non-wicking satin material such as polyester or alternatively silk; this breathable, friction reducing outer shell aids in retaining moisture which is beneficial to dry and curly hair. A second middle shell is a thin multi-membrane thermal fabric which provides warmth to the hair and head of the wearer. This shell is created for direct contact with the wearer by encasing it in a similar or same choice performance material used for the first outer shell. The third inner shell also created for direct contact with the wearer is a waterproof fabric. This waterproof fabric does not wick away moisture and allows wet hair to retain its high levels of moisture while keeping the hat member dry. The three shells are removable, reusable and interchangeable and can be worn as a single shell lining inside the cap, hat member or head-wear.

DETAILED DESCRIPTION OF THE INVENTION

Figure 1:
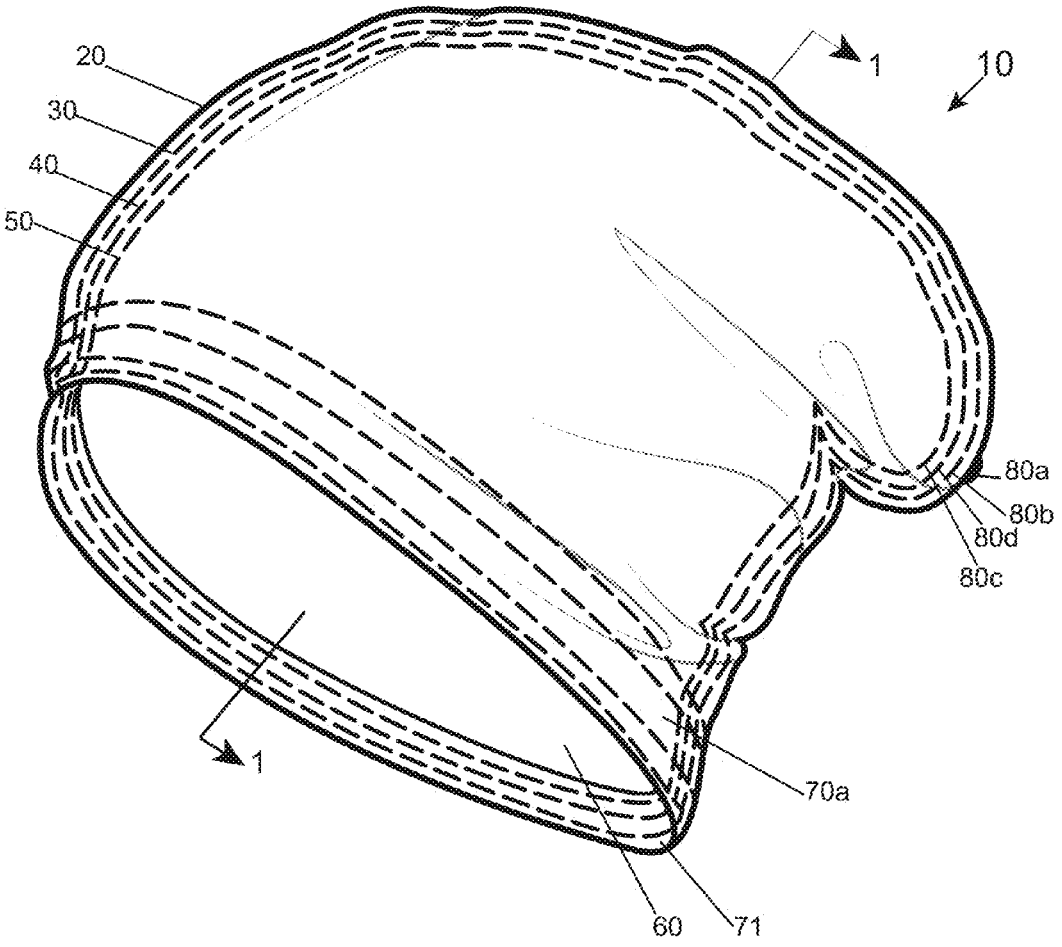
FIG. 1 is an isometric side view.

With reference now to the drawings and in particular FIG. 1 through FIG. 5 thereof, a preferred embodiment of the head-wear assembly designated by reference number 10 is shown. The present invention 60 is a removable, reusable, interchangeable lining configured specifically for placement in head-wear 20 and is comprised of a composite of three dome shaped shells 30, 40, 50 with continuous, elongated walls. Because naturally dry hair and curly hair are more susceptible to damage from head-wear which wicks away moisture and causes friction the inventive head-wear lining 60 is created to maintain the moisture levels of naturally dry and curly hair and reduce friction which causes frizzing and breakage of said dry and curly hair. Most head-wear is created from materials that wick away moisture and create friction against hair strands causing the hair's cuticles to lift; this lifting can cause hair to frizz, dry out and become even more prone to breaking. The performance properties of each shell 30, 40, 50 in the present inventive lining 60 combine for optimal hair moisture retention, warmth and reduction of frizz and hair breakage.

In order to prevent dry and curly hair from being damaged by head-wear 20 it is necessary to have a lining 60 which is made from performance materials that are highly compatible to such easily damaged hair. The composite of shells that make up the lining 60 are comprised of choice performance material. The outer shell 30, of the lining 60, intended for contact with the wearer is created from a material that is a satin which helps maintain moisture instead of wicking a majority of it away and reduce frizz and breakage of hair. Satin is a specific weave of natural and synthetic fibers and this weave creates a fabric with a highly smooth surface. Silk a natural, breathable material and polyester can be weaved as satin and are the preferred materials used for the first outer shell. The highly, smooth surface of the satin material glides across hair strands creating little to no friction. Because there is little to no friction created by the outer shell 30 the hair cuticles do not lift which prevents moisture from escaping the hair's cortex. The reduced friction is also beneficial to the hair strand not breaking due to brittleness from continued drying out. The outer shell 30 of the inventive lining 60 can be used in combination with the thermal middle shell 40 and the thermoplastic polyurethane inner shell 50 or alone as a single shell described subsequently in further detail.

The middle shell component 40 of the lining 60 is a thin material with thermal properties. Thin thermal fabrics act by either reflecting body heat back towards the body with reflective fabrics or by capturing body heat within tight weaves and holding on to it. The preferred thermal fabric is one that is very thin, flexible and soft with a high warmth-to-thickness ratio. The thermal fabric blocks radiant heat loss with its fine microfibers capturing the heat generated from the wearer while also being a breathable material. The thermal middle shell 40 is adapted to come in contact with the wearer by encasing it in the same or a similar performance material used for the outer shell, a non wicking satin. The thermal middle shell 40 sits within the outer shell 30 as the inner shell 50 sits within the thermal middle shell 40. The thermal middle shell does not impede the ability of the outer shell 30, 70*b* or inner shell 50, 70*c* from attaching to the head-wear 20, 70*a* via a hook and loop attachment system. The middle thermal shell 40 also has its own means of attachment at the crown 80*d* and peripheral edge 70*d* of the shell for securing it to the head-wear 20.

The purpose of the thermal middle shell 40 is to create warmth for the wearer and hair with conditioner or oil on it. Those with dry and curly hair will typically deep condition their hair for extended periods of time, including overnight. It is suggested that heat helps conditioner and oil penetrate the hair shaft. The warmth maintained by a thin thermal shell 40 will radiate heat back towards the wearer's hair and thus aid in deep conditioning the hair. A great advantage to having composite shells that are not permanently joined is that in hotter temperatures the thermal middle shell 40 can be easily removed, as well as a choice of the outer shell 30 or inner shell 50, allowing for a head-wear assembly which is cooler in hotter temperatures.

The third inner shell 50 of the inventive lining 60 is a waterproof material such as, but not limited to, thermoplastic polyurethane (TPU) which is a very thin, flexible, soft and smooth material with high elasticity. This material is waterproof as well as oil and grease resistant. A large percentage of those with dry and curly hair use oils to help seal in the moisture of their hair strands. Oils can sometimes breakdown and erode waterproof barriers and stain fabrics. Thermoplastic polyurethane hence forth referred to as TPU is a perfect choice for dry and curly hair because of its combination of waterproofing and oil resistance.

The TPU inner shell 50, of the inventive lining 60, enables those with damp hair to deep condition or perform hot oil treatments while wearing their head-wear and the combination of the TPU shell 50 along with the thermal middle shell 40 allows for a deeper conditioning and or prolonged hot oil treatment due to the warmth of the thermal middle shell 40. TPU has a highly smooth surface that eliminates friction and thus aids in reducing frizz and hair breakage. The TPU shell 50 is intended for contact with the wearer and does not wick away moisture but rather retains it due to its' waterproofing nature. It can be appreciated by one skilled in the art that the TPU inner shell 50 and the satin outer shell 30 can be chemically bonded essentially creating a reversible liner which is still within the scope of the invention.

Figure 2:
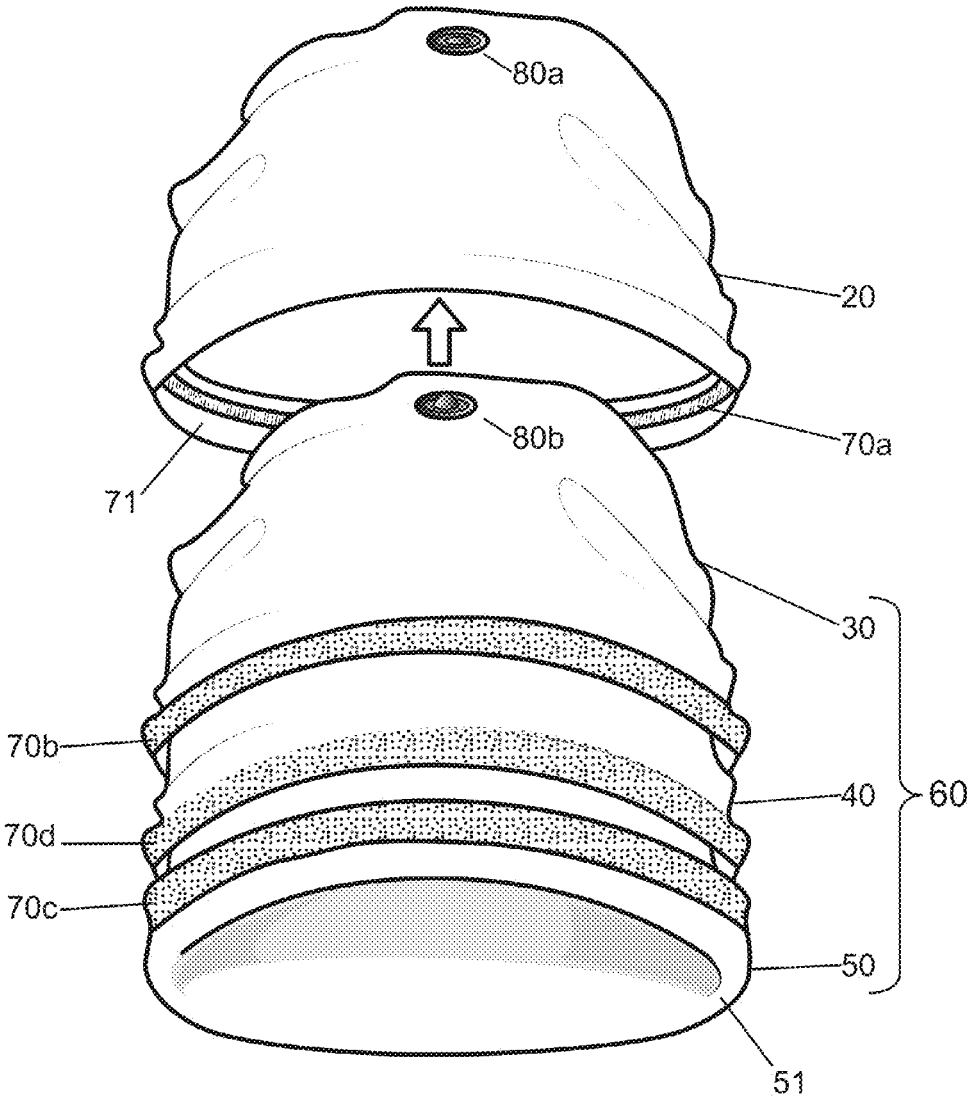
FIG. 2 is an exploded frontal view.
Figure 3:
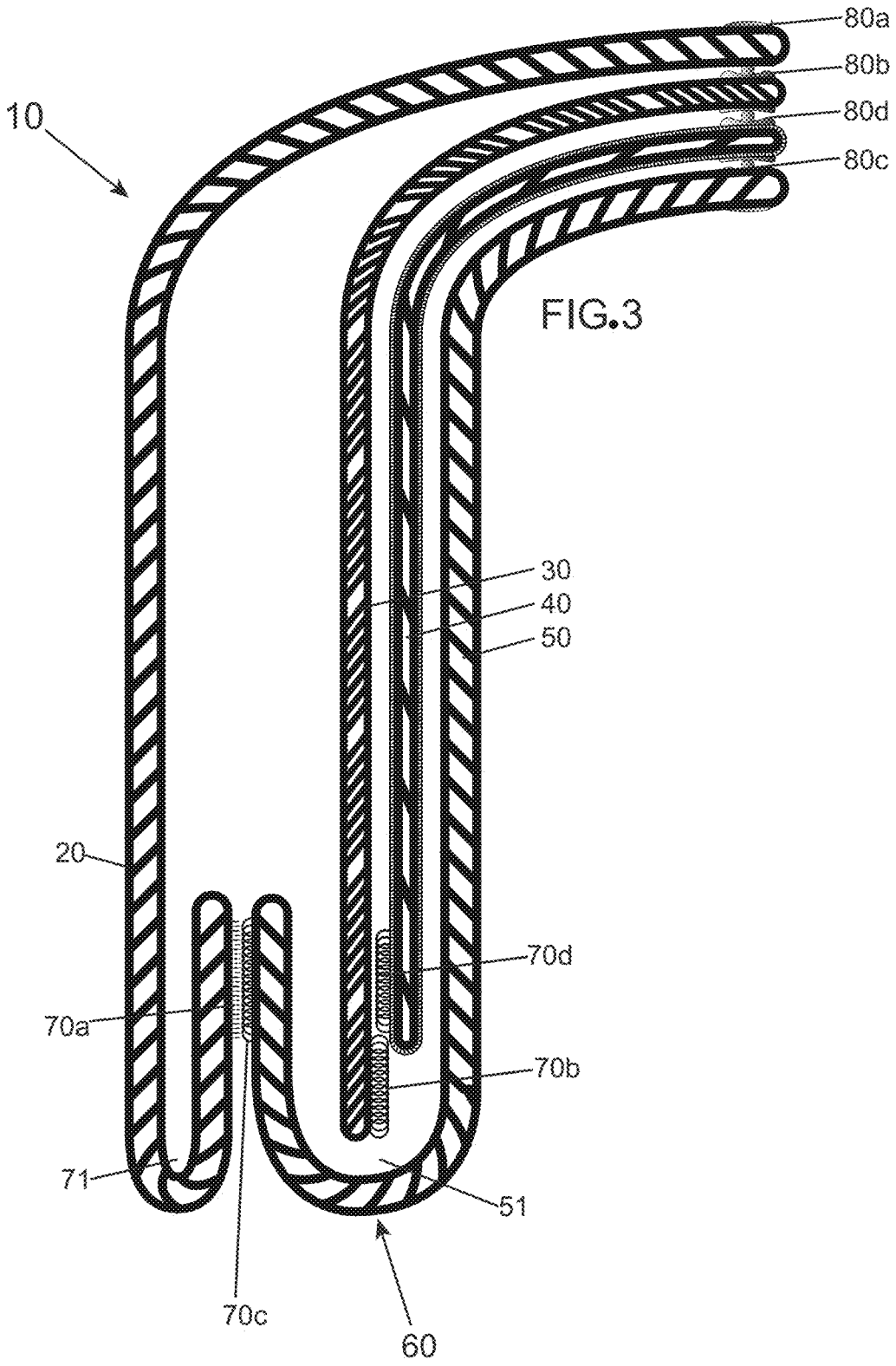
FIG. 3 is a cross sectional view along line 1-1 of FIG. 1.

The inner shell 50, 70*c*, middle shell 40, 70*d* and outer shell 30, 70*b* lining 60 secure to the head-wear 20, 70*a* via means of an attachment system. The attachment system 70*a*, 70*b*, 70*c*, 70*d* illustrated in FIG. 2 and FIG. 3 is a hook and loop system but those skilled in the art should recognized it could also be, but is not limited to, snap buttons and zippers to name but a few different kinds of attachment systems. The headwear 20 inside hem 71 holds the hook side 70*a* of the attachment system while the outer shell 30, 70*b*, middle shell 40, 70*d* and the inner shell 50, 70*c* have loops attached to their peripheral edges of the elongated, continuous walls. At the crown of the head-wear 20, 80*a* there is also a female part of a snap button system to prevent sagging. The snap part 80*a* of the head-wear 20 attaches to the male snap button parts of the satin outer shell 80*b*, thermal middle shell 80*d* and the TPU inner shell 80*c*. Those skilled in the art will recognize that this attachment system can also be but is not limited to a hook and loop system as well as other various attachment systems.

Figure 4:
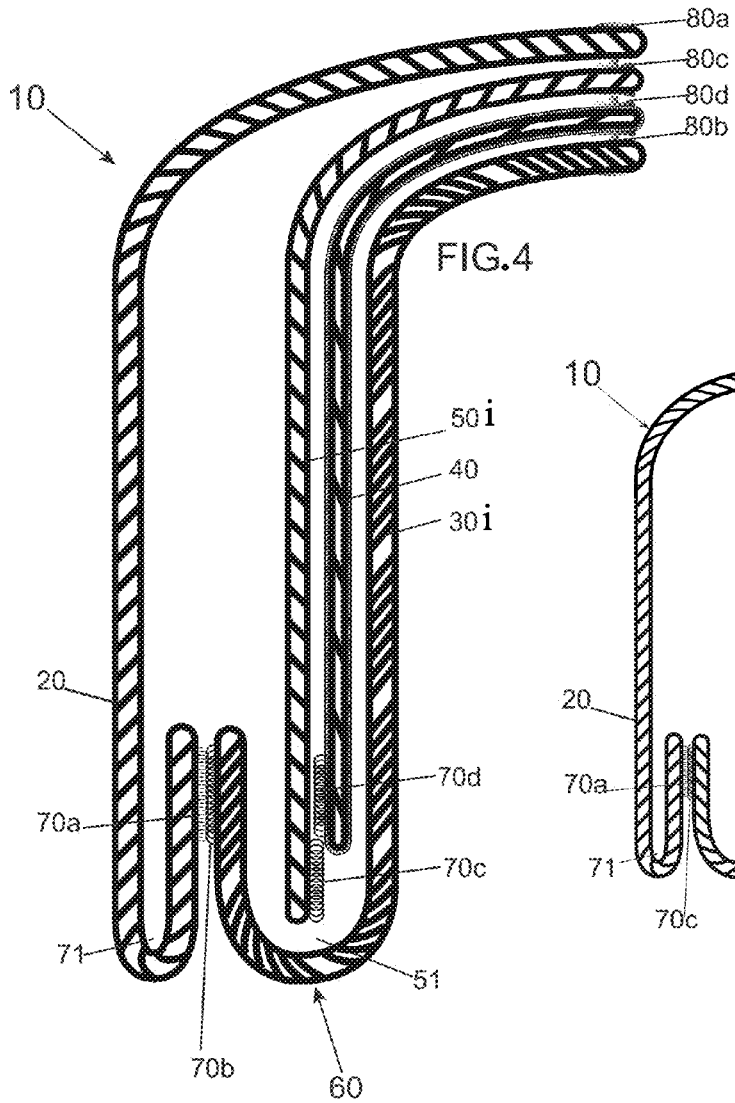
FIG. 4 modified form
FIG. 5 modified form

Although the orientation of the shells creating the lining can be interchanged, as seen in FIG. 4, there is nevertheless, for purposes of disclosure, a preferred embodiment as illustrated by FIG. 1-FIG. 3 where the outer shell 30 connects via a snap button attachment system located on its exterior crown 80*b* to the interior crown of the head-wear 20, 80*a*. This crown snap button attachment 80*a*, 80*b* prevents the outer shell 30 from collapsing inwards. The middle shell 40 sits within the outer shell 30 and the inner shell 50 sits within the middle shell. Both the outer shell 30 and middle shell 40 peripheral edges sit within a shallow pocket 51 created from the inner shell 50 peripheral edge being folded outwards from its cavity and up. The inner shell 50, 70*c* attaches to the head-wear 20, 70*a* via the attachment hook and loop system.

The satin outer shell 30 of FIG. 3 can be interchanged with the TPU inner shell 50 of FIG. 3, as seen in FIG. 4, thus then becoming the inner shell 30*i* of FIG. 4. This satin inner shell 30*i* will then sit within the thermal middle shell 40 as the thermal middle shell 40 sits within the TPU outer shell 50*i*. The satin inner shell's peripheral edge 70*b* with attachment loops then folds outwards from its cavity and up creating a shallow pocket which holds the peripheral edges of the thermal middle shell 40 and the now TPU outer shell 50*i*. This fold enables the satin inner shell 30*i*, 70*b* peripheral edge with loop to attach to the head-wear 20, 70*a* hook. To prevent the crown from collapsing in this configuration the TPU outer shell 50*i*, 80*c* fastens via the snap button attachment system to the head-wear 20, 80*a*.

Figure 5:
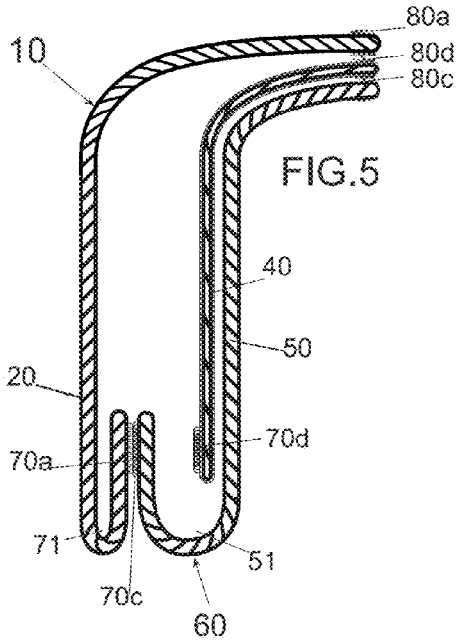

If the wearer desires to have minimum moisture retention and no warmth while still reducing friction then the TPU inner shell 50 along with the thermal middle shell 40 can be quickly and easily removed allowing the satin outer shell 30 to be used solely as a single shell lining. The satin shell would then attach to the head-wear 20, 70*a*, 80*a* via its loop 70*b* and snap button part 80*b*. As shown in FIG. 5 a composite of two shells, the middle thermal shell 40 with either the satin outer shell 30 or as illustrated in FIG. 5 the inner TPU shell 50 can also be formed to suit the wearer's needs of warmth and moisture retention with either dry hair or wet hair. Other orientations of the lining 60 are the thermal middle shell 40 and the TPU inner shell 50 worn as single shell linings that still maintain moisture, reduce friction and thus reduce frizzing and drying of dry and curly hair while giving added warmth in the case of the thermal middle shell 40.

Other modifications and changes with different assembly will be apparent to those skilled in the art, the invention is not considered limited to the given examples chosen for purposes of disclosure and covers all changes and modifications which do not constitute a departure from the true spirit and scope of the invention which is to retain hair moisture and reduce friction against hair while allowing for easy thermal control. For example the removable, reusable and interchangeable multi-shell lining can be bonded together creating a reversible triple shell lining that is not interchangeable but remains within the scope of the invention. A TPU lining can be added as the sole liner of a hat, cap or head-wear for purposes of deep conditioning and hot oil treatments with or without a means of attaching and detaching it so that it can be interchanged with a satin lining or satin-encased thermal lining. One skilled in the art will also recognize that a head scarf can be adapted to have the aforementioned shells, lining, layers.

What is claimed is:

1. A headwear assembly comprising:

an article of headwear comprising an attachment system at both a peripheral edge and crown thereof; and three shells comprising an inner shell, a middle shell and an outer shell, the three shells being interchangeable and being of dome shaped shells, the inner shell comprising a waterproof material configured to retain moisture on hair of a wearer during sleep conditioning and hot oil treatments, the middle shell comprising a thermal fabric configured to increase warmth of a head of the wearer, the outer shell comprising satin or silk configured to reduce friction and maintain moisture of the hair of the wearer, each shell of the three shells comprising an attachment system at both a peripheral edge and crown thereof configured to selectively attach said each shell to at least one other of the three shells and/or the article of headwear to customize moisture and thermal levels for the wearer;

wherein the three shells are configured to be secured together with the article of headwear to achieve maximum moisture retention and warmth during use.

2. The headwear assembly of claim 1, wherein the attachment system at the peripheral edge of each shell and the attachment system at the peripheral edge of the article of headwear include hook and loop fasteners.

3. The headwear assembly of claim 2, wherein the attachment system at the crown of each shell and the attachment system at the crown of the article of headwear include snap fasteners.

* * * * *